US008877012B2

(12) United States Patent
Rawls et al.

(10) Patent No.: US 8,877,012 B2
(45) Date of Patent: Nov. 4, 2014

(54) PIPING SYSTEM FROM REACTOR TO SEPARATOR AND METHOD TO CONTROL PROCESS FLOW

(71) Applicant: Andritz Inc., Glens Falls, NY (US)

(72) Inventors: Joseph Monroe Rawls, Alpharetta, GA (US); Thomas Pschorn, Sherbrooke, CA (US); Bertil Stromberg, Diamond Point, NY (US); Patrick Pepin, Queensbury, NY (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 14/049,275

(22) Filed: Oct. 9, 2013

(65) Prior Publication Data

US 2014/0110069 A1 Apr. 24, 2014

Related U.S. Application Data

(60) Provisional application No. 61/717,684, filed on Oct. 24, 2012.

(51) Int. Cl.

| | |
|---|---|
| ***D21B 1/36*** | (2006.01) |
| ***B01J 3/02*** | (2006.01) |
| ***D21C 7/08*** | (2006.01) |
| ***D21C 1/02*** | (2006.01) |

(52) U.S. Cl.
CPC ... *D21C 1/02* (2013.01); *D21B 1/36* (2013.01)
USPC ..... 162/247; 162/21

(58) Field of Classification Search
CPC ..... D21B 1/36; B01J 3/02; D21C 7/08
USPC ..... 162/21, 247
See application file for complete search history.

(56) References Cited

U.S. PATENT DOCUMENTS

| | | | | |
|---|---|---|---|---|
| 5,262,003 | A * | 11/1993 | Chupka et al. | 162/4 |
| 7,540,938 | B2 * | 6/2009 | Munster | 162/47 |
| 8,512,512 | B2 | 8/2013 | Pschorn | |
| 2008/0277082 | A1 | 11/2008 | Pschorn | |
| 2009/0221814 | A1 * | 9/2009 | Pschorn et al. | 536/128 |

(Continued)

FOREIGN PATENT DOCUMENTS

WO 2009/108773 9/2009

OTHER PUBLICATIONS

Philippe Ponsaud, Extended European Search Report and opinion, EP patent application No. 13189264, corresponds to U.S. Appl. No. 14/049,275, Jan. 9, 2014, 1-4, Germany.

*Primary Examiner* — Anthony Calandra
(74) *Attorney, Agent, or Firm* — Nixon & Vanderhye P.C.

(57) ABSTRACT

An apparatus, for the steam explosion treatment of biomass, having a pressurized reactor vessel to receive a biomass material and steam, discharge lines connecting the pressurized reactor vessel to the separation device, the lines sized and positioned to allow for the steam explosion of biomass material. At the outlet end of the discharge lines is a collection-expansion manifold to connect the outlet end of each of the discharge lines to a collection line, wherein the collection line provides a passage for biomass material and steam flowing from the discharge lines. The collection line passage has a substantially larger cross-sectional area than the cross-sectional area of a single discharge line. The collection line is coupled to a separation device such that the separation device receives the biomass material and steam from the collection line.

17 Claims, 5 Drawing Sheets

(56) References Cited

U.S. PATENT DOCUMENTS

2010/0233769 A1* 9/2010 Heathcote et al. ..... 435/157
2011/0185894 A1* 8/2011 Olsson ..... 95/23
2012/0211512 A1 8/2012 Pschorn et al.
2013/0206346 A1* 8/2013 Hunt et al. ..... 162/29
2013/0340275 A1* 12/2013 Vaders ..... 34/480

* cited by examiner

PIPING SYSTEM FROM REACTOR TO SEPARATOR AND METHOD TO CONTROL PROCESS FLOW

CROSS-REFERENCE TO PRIOR APPLICATION

This application claims the benefit of priority to U.S. App. No. 61/717,684 filed on Oct. 24, 2012, the entire contents of which are incorporated herein by reference.

BACKGROUND OF THE INVENTION

Current steam explosion systems usually consist of a reactor vessel, a piping system, and a separation device. The reactor vessel holds steam-infused biomaterial under pressure. The steam-infused biomass material rapidly depressurizes in the piping system as it is conveyed from the reactor vessel to the separation device. The separation device recaptures steam and other desirable gasses.

The piping systems have traditionally been susceptible to plugging, blocking, or obstruction by the biomass material that flows through them. When obstructed, traditional steam explosion systems are generally shut down for maintenance. This may result in a loss of production. Many piping system features that contribute to this problem.

BRIEF DESCRIPTION OF THE INVENTION

In steam explosion systems, it is desirable and typical for the pipes in these piping systems to have a small diameter to minimize steam consumption because excessive steam use increases production costs. Small pipe diameters may help accomplish this goal but unfortunately, these small diameters also contribute to blockage.

The pipes in the piping systems typically contain several restriction devices such as valves, bends, elbows, and lengthy passages. The valves may sometimes be set to partially opened positions to achieve different desired flow rates of biomass material and steam. These partially opened valves may present valve edges within the pipes that are prone to catching deposits of biomass material. As these biomass deposits accumulate, the pipes become plugged, blocked, or obstructed.

Further, flow velocities approaching the speed of sound are typical in systems that operate with a high pressure drop from the reactor to the separation device. As a result, the valves and other movable parts within the piping systems can wear out frequently requiring repair or replacement.

Efforts to reduce the amount of plugging, blocking, or obstruction in a piping system have generally involved shortening the length of piping between the reactor vessel and the separation device. The diameter of the piping may also be increased, but this may require an increased quantity of steam usage. Shortening the piping reduces the surface area and edges on which biomass deposits may become caught. To shorten the piping, the reactor vessel and separation device must be physically close to each other. Space limitations and other equipment can impose difficulties in proximally locating a reactor vessel and separation device.

There is a long felt need for piping systems used in steam explosion systems that are less susceptible to biomass deposits and that have relatively few components that are prone to wear, while also allowing for a means to adjust the steam flow from the reactor vessel to the separation device.

The present embodiment generally relates to piping systems for mixtures of steam and biomass material flowing from a pressurized reactor vessel, and particularly relates to piping systems between a pressurized reactor vessel for a steam explosion process and a separation device. This embodiment allows for steam and biomass material to flow through the piping system, which may be adjusted by changing the piping lengths and adjusting the location of the collection-expansion manifold relative to the discharge lines of the pressurized reactor vessel.

A method and a system have been conceived to control or limit steam flow out of the pressurized reactor vessel where a pressurized reactor vessel is connected by piping to a separation device. For the purposes of this application, "piping" or "pipe" refers to any conduit that may be used in a steam explosion system. The steam explosion system includes a pressurized reactor vessel, such as a steam explosion pressurized reactor vessel that has at least one discharge line that allows the biomass material and steam from the pressurized reactor vessel to flow to a point where the discharge lines connect to a single conduit. This conduit is known as the "collection line" and the point at which the discharge lines connect is known as the "collection-expansion manifold." As the biomass material and steam flow through the collection-expansion manifold, a rapid pressure release occurs. This rapid pressure release causes the biomass material to undergo a steam explosion process as it flows through the collection line and into the separation device.

Each individual discharge line may have a different diameter from each other individual discharge line. In other embodiments, two or more discharge lines may share substantially the same diameter. Each individual discharge line may also have a valve at an inlet end. These valves may be used to control the flow rate of biomass material and steam into each individual discharge line. By using these valves and discharge lines with different diameters, operators may adjust the flow rate of biomass material and steam from the pressurized reactor vessel.

The length of the discharge lines may also be changed to allow for adjustment of the flow rate of biomass material and steam through the discharge lines. The proximity of the collection-expansion manifold to reactor vessel outlets can be adjusted by adding or removing piping length, to thereby regulate the amount of biomass material and steam exiting the pressurized reactor vessel under normal operating conditions. Additionally, if desired, there are other optional components such as nozzle inserts, orifice plates, and valves that can be used as needed to adjust the flow rate of biomass material and steam through the discharge lines. Further, the valve in one or more of the openings for the inlet end of the discharge lines may define a flow passage. This "flow passage" refers to the internal diameter of a discharge line, which may be constant with the diameter of a given valve. The flow passage may have a cross-sectional area that is larger or smaller than the cross-sectional area of another valve located in another inlet end of another discharge line. For example, one or two of the valves may define a flow passage having a cross-sectional area that is one half the cross-sectional area of the flow passage defined by the other valves.

An apparatus has been conceived for steam explosion treatment of biomass material comprising: a pressurized reactor vessel configured to contain biomass material and steam at least one discharge line coupled to an outlet of the pressurized reactor vessel, wherein the at least one discharge line has a cross-sectional area, and wherein the at least one discharge line is configured to receive the biomass material and the steam discharged from the pressurized reactor vessel, a collection-expansion manifold connected to an outlet end of the at least one discharge line, a collection line having an inlet connected to the collection-expansion manifold, wherein the collection line is configured to receive the biomass material and the steam flowing from the outlet end of the at least one discharge line, and wherein the collection line has a cross-sectional area that is substantially larger than the cumulative cross-sectional area of the at least one discharge line, and a separation device coupled to an outlet end of the collection line to receive the biomass material and the steam from the collection line, and the separation device includes a gas outlet and a biomass material outlet.

The length of each of the discharge lines may be substantially shorter than the length of the collection line. More commonly, the length of each of the discharge lines is substantially shorter than the total length of the line from the pressurized reactor vessel outlet to the separation device inlet in a conventional system. In conventional systems, the discharge line connects the pressurized reactor vessel to the separation device. In some embodiments, the internal passage diameter of each of the discharge lines is uniform through the discharge line. The internal passage diameters of each of the discharge lines may vary widely. However, in some embodiments, the internal passage diameters may fall within a range from 0.125 inches to 120 inches. Moreover, for pressurized reactor vessels that measure two meters by three meters, the internal passage diameters may have a range of 0.25 inches to 6.0 inches, or 0.125 inches to 0.75 inches, or 1.0 inches to 2.5 inches, or a range where the upper limit is 4.0 inches.

With regard to the collection-expansion manifold, the collection-expansion manifold may be a flat plate having a first side of the collection-expansion manifold connected to the discharge lines and an opposite side connected to the collection line with opening throughout the collection-expansion manifold, each of which is aligned with one of the discharge lines.

With regard to the collection line, the internal passage diameter in the collection line may be at least twice to four-hundred times the cross-sectional areas of the passages of a single discharge line. The pressure in the inlet of the collection line may be substantially less, such as less than three-quarters, even less than one-half, than the pressure in the exit of the discharge line. A valve, such as a fully-open valve, may be placed between the pressurized reactor vessel and the inlet of each of the discharge lines or in the discharge line. The number of discharge lines is at least two or three, or more discharge lines. Should a single discharge line feed a single collection line, it may be possible to have multiple separate collection lines. The individual collection lines could combine into yet another collection line further down the piping system.

In another embodiment, an apparatus has been conceived for steam explosion treatment of biomass material comprising: at least one discharge line extending from the pressurized reactor vessel at reactor vessel outlets, wherein the at least one discharge line has a cross-sectional area, and wherein the at least one discharge line is configured to receive the biomass material and the steam discharged from the pressurized reactor vessel, a collection-expansion manifold connected to an outlet end of the at least one discharge line, a collection line having an inlet connected to the collection-expansion manifold, wherein the collection line is configured to receive the biomass material and the steam flowing from the at least one discharge line, and wherein the collection line has a cross-sectional area that is substantially larger than the cross-sectional area of the at least one discharge line and a separation device coupled to an outlet end of the collection line, wherein the separation device is configured to receive the biomass material and the steam from the collection line.

A method for steam explosion treatment has been conceived comprising: pressurizing and infusing biomass material with steam, passing the pressurized and infused biomass material and steam through a number of discharge lines, from each of the discharge lines, passing the pressurized and infused biomass material through a collection-expansion manifold and into a collection line, rapidly reducing pressure on the infused biomass material as the infused biomass material enters the collection line from the collection-expansion manifold, treating the infused biomass material with a steam explosion process due to the rapid reduction in pressure, and transporting the steam exploded biomass material through the collection line to a separation device in which the steam exploded biomass material is separated from gases flowing with the steam exploded biomass material in the collection line. This separation device may be a cyclone separator, a gravity settler, an impingement separator, or any other separation device used to recover gas from mixtures.

The distance travelled by the biomass material through the discharge lines may be substantially shorter than the distance the biomass material travels through the collection line. Additionally, the distance travelled by the biomass material and steam through the discharge lines is substantially shorter than the total length of the piping from the reactor outlets to the separation device inlet in a conventional system. For example, the discharge lines may be 10% to 60% of the total length of piping running from the reactor outlets to the separation device inlet depending on project-specific equipment layouts. At least one of the discharge lines may be closed to biomass material by a valve between the pressurized reactor vessel and the inlet end of the at least one discharge line while at least one other discharge line is open to biomass material and steam.

DETAILED DESCRIPTION OF THE INVENTION

Figure 1:
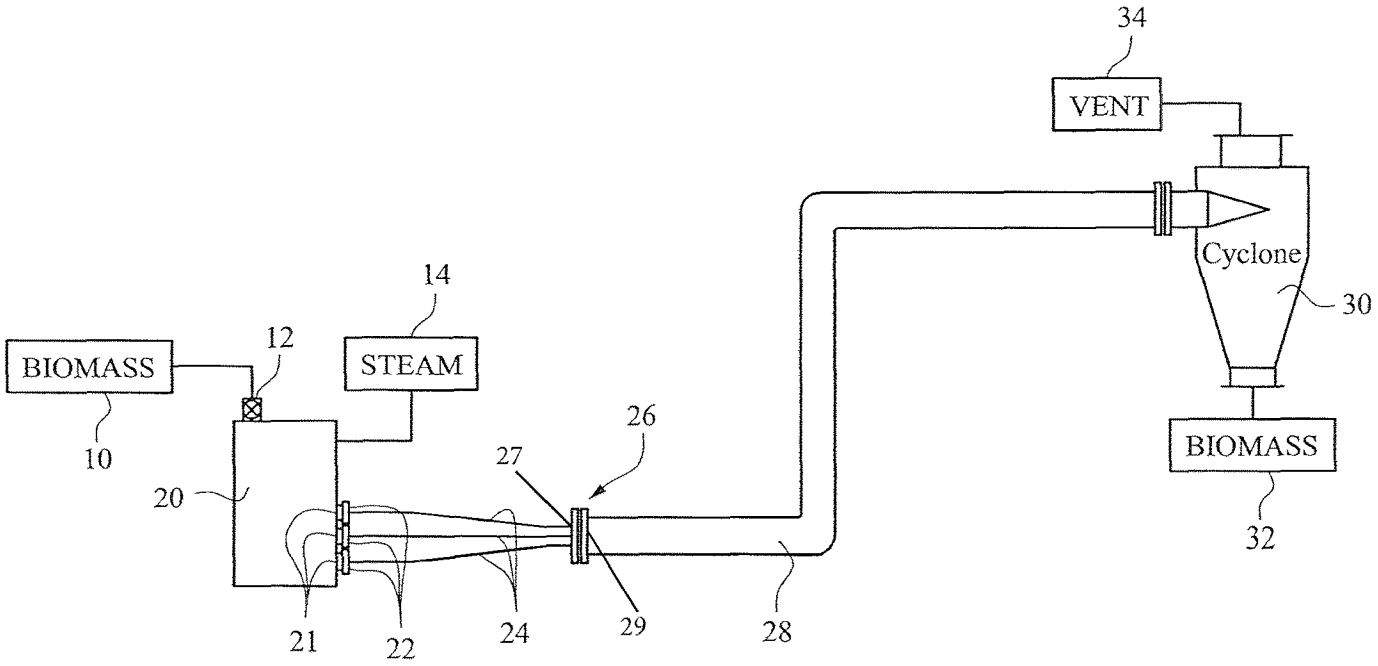
FIG. 1 is process flow diagram showing a side view of a pressurized reactor vessel, discharge lines, a collection-expansion manifold, a collection line, and a separation device.
Figure 2:
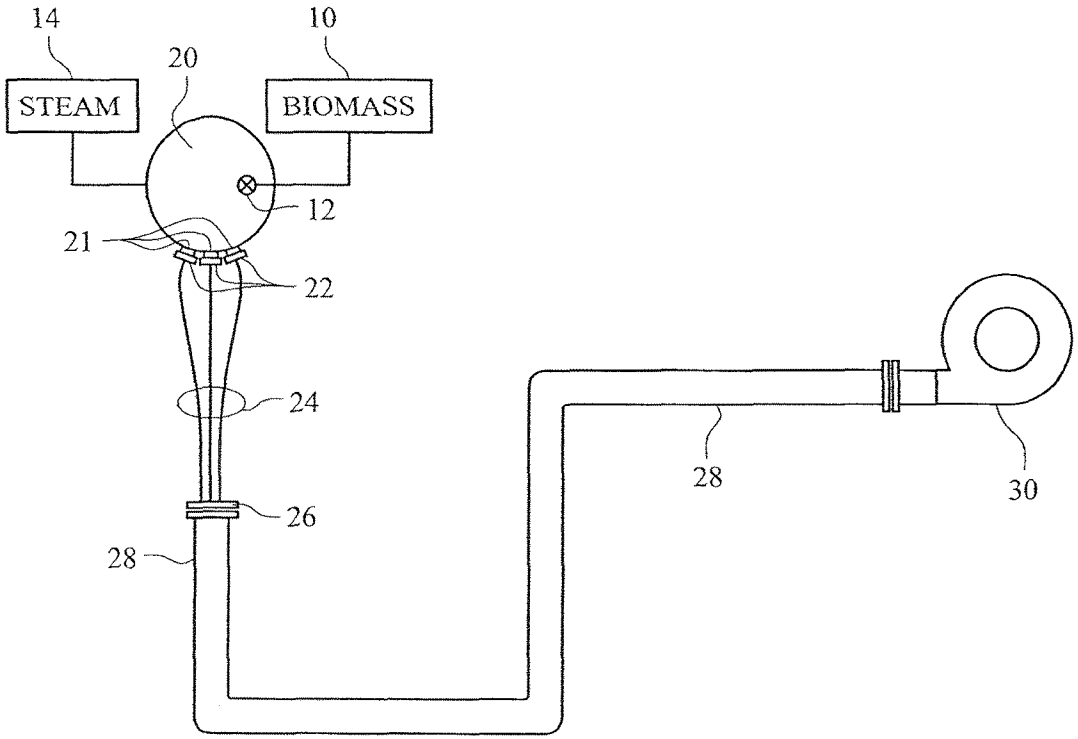
FIG. 2 is a process flow diagram showing a top view of the pressurized reactor vessel, discharge lines, a collection-expansion manifold, the collection line and the separation device.

FIGS. 1 and 2 illustrate a steam explosion process in which pressurized steam is infused into a biomass material, such as lignocellulosic material. By rapidly releasing the pressure, the steam expands within the biomass material and bursts the cells of the biomass material or defibrillates the biomass material. The biomass material may be lignocellulosic material. Lignocellulosic material includes, but is not limited to: plant material such as wood, wood chips, sawmill and paper mill discards, corn stover, sugarcane bagasse, and other agricultural residues, dedicated energy crops, municipal paper waste, and any other biomass material composed of cellulose, hemicellulose, and lignin.

In this example embodiment of an apparatus for steam explosion treatment, a pressurized reactor vessel 20 receives the biomass material 10 via a high pressure transfer device 12 which conveys the biomass material 10 into a high pressure environment in the pressurized reactor vessel 20. The biomass material 10 may flow continually to the pressurized reactor vessel 20. In other example embodiments, the biomass material 10 may be fed into the pressurized reactor vessel 20 in a batch, semi-batch, or semi-continuous process.

Steam 14 is added to the pressurized reactor vessel 20 to add energy to the biomass material 10. The energy increases the temperature and pressure of the biomass material 10 in the pressurized reactor vessel 20. The temperature in the pressurized reactor vessel 20 may be in a range of 120° C. to 300° C., possibly 150° C. to 260° C., possibly 160° C. to 230° C. The temperature of the biomass material 10 may also be outside this range, depending on the type of biomass material and the steam explosion process the biomass material is to undergo.

The pressurized reactor vessel 20 may have multiple reactor vessel outlets 21. Each reactor vessel outlet may communicate with a valve 22 and at least one discharge line 24. Each discharge line 24 may have a discharge line outlet end 27 connected to a collection-expansion manifold 26. The collection-expansion manifold 26 may provide a connection between each discharge line outlet end 27 and a single large diameter collection line 28.

The flows of steam and biomass material from the discharge lines 24 pass through the collection-expansion manifold 26, and enter and merge at the collection line 28. The position of the collection-expansion manifold 26 to the biomass material and steam exiting the pressurized reactor vessel 20 can be adjusted by adding or removing piping length, to thereby regulate the amount of steam exiting the pressurized reactor vessel 20 under normal operating conditions. The pressure at the inlet of the collection line 29 may be substantially less, such as less than three-quarters, even less than one-half, than the pressure at each of the discharge line outlet ends 27 that are open to the flow of biomass material and steam. A rapid pressure release occurs as the biomass material and steam pass through the collection-expansion manifold 26 and into the collection line 28. The rapid pressure release causes the biomass material to undergo a steam explosion process as it flows into the collection line 28.

The cross-sectional area of the collection line may be substantially greater than any one of the cross-sectional areas of the one or more discharge lines 24 and may even be substantially greater than the sum of the cross-sectional areas of the discharge lines 24. The cross-sectional area of the collection line 28 may be greater than the cross-sectional area of any one of the discharge lines 24 by at least a factor of two. In other example embodiments, the cross-sectional area of the collection line 28 may be greater than the cross-sectional area of any one of the discharge lines by at least a factor of five or at least a factor of six. The cross-sectional area change can be accomplished by a sudden pipe enlargement, a step out or a series of step outs, conical pipe sections, eccentric and concentric pipe reducers, pipe increasers or other gradual means to change pipe diameter.

The inlet of the collection line 29 is at the collection-expansion manifold 26. Although any separation device may be used, in this example embodiment a cyclone separator 30 communicates with the collection line 28. The cyclone separator 30 may be used to separate the steam exploded biomass and steam from collection line 28 to produce the processed biomass 32 and gas 34. There may be multiple cyclone separators 30 and multiple collection lines 28.

The length of each of the discharge lines 24 may be relatively short, such as in a range of 0.4 meter to 30 meters. Limiting the length of the discharge lines 24 reduces the internal surface area, known as the "wetted" surface area, in the smaller diameter passages of the discharge lines 24 and allows the discharge lines 24 to be relatively free of pipe fittings, bends, elbows and other potential sources for collecting biomass deposits. In addition, the cross-sectional area of the internal passage diameter for at least one discharge line 24 may differ, e.g., greater by 50 percent or 100 percent, from a cross-sectional area of another one or more of the discharge lines 24 connected to the pressurized reactor vessel 20.

The multiple discharge lines 24, which can be individually opened or closed via the valves 22 provide a range of biomass material and steam flow rates through the open discharge lines that can be selected. For example, a relatively low flow rate may be achieved by opening just one valve 22 and closing the remaining valves 22 such that biomass material and steam flow through just one of the discharge lines 24. The flow rate of biomass material and steam may be increased incrementally by opening valves 22 for each of the other discharge lines 24. The number of flow rates that may be selected by selectively opening and closing the valves 22 may be greater than the number of discharge lines 24 if the discharge lines 24 have different internal passage diameter cross-sectional areas. For example, if at least all but one of the discharge lines 24 have a biomass material and steam passage cross-sectional area that is twice (100 percent greater) than the cross-sectional area of the internal passage diameter of the remaining discharge line 24, the remaining discharge line 24 may be opened or closed to provide a half-step increment in the flow that occurs when the valves 22 are opened or closed to the other discharge lines 24.

The one or more discharge lines 24 may each be relatively free of control devices such as throttling valves, nozzle inserts, reduced port valves, orifice plates, and other restriction devices. The valves 22 at the inlet end the discharge lines at the reactor vessel outlets 21 may be the only control device in each discharge line 24. To control the flow of steam and biomass material from the pressurized reactor vessel 20 the valves 22 are in a fully opened, partially opened, or fully closed operating position to select one or more of the discharge lines 24 as passages for the steam and biomass material. Minimizing the restriction devices in the discharge lines 24 reduces the tendency of the discharge lines 24 to become plugged, blocked, or obstructed with biomass material and/or tramp material and reduces the risk of failure due to worn restriction devices.

The collection line 28 is a large diameter conduit that may have a smooth wetted surface that is exposed to the biomass material and steam. Due to the collection line's large internal diameter and large cross-sectional area, the collection line 28 may be less prone to being plugged, blocked, or obstructed by biomass depositing on the wetted surface of the collection line 28.

Due to its large diameter, the collection line 28 may extend a substantially longer distance than the discharge lines 24 without a significant risk of becoming plugged, blocked, or obstructed with biomass deposits. The length of the collection line 28 may be substantially longer than any one of the discharge lines 24, such as two to twenty times the length of each of the one or more discharge lines 24.

Figure 3:
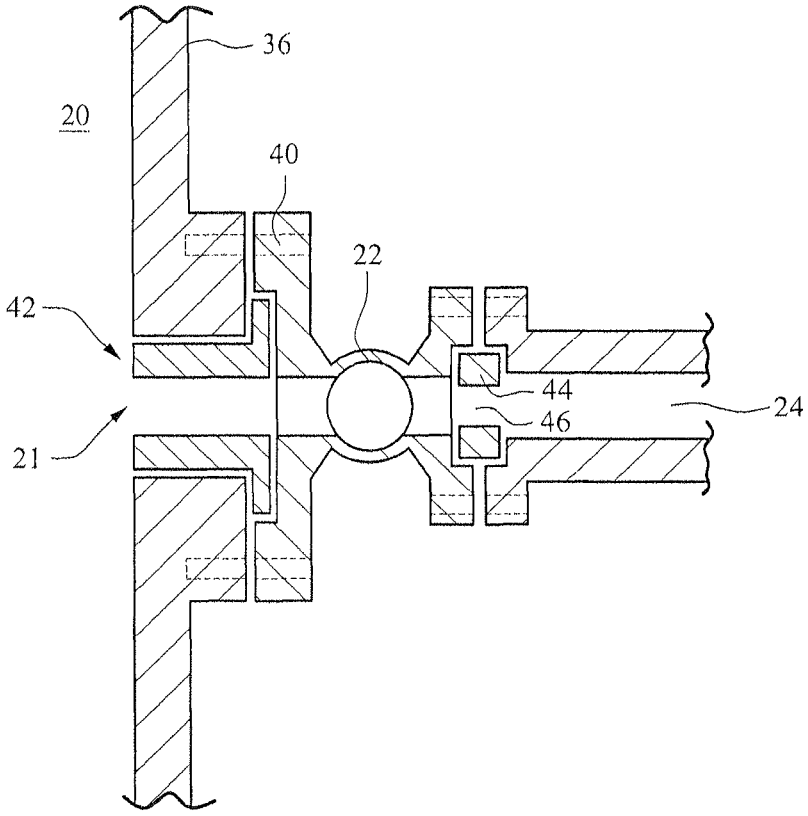
FIG. 3 is a schematic diagram of an example embodiment of portion of the pressurized reactor vessel, a nozzle insert, valve, orifice plate, and inlet end to a discharge line.

FIG. 3 is a schematic diagram showing the coupling of at least one, possibly two or more, of the discharge lines 24 to the pressurized reactor vessel 20. The coupling between each of the discharge lines 24 and the pressurized reactor vessel 20 may be substantially the same as the coupling shown in FIG. 3. The sidewall 36 of the pressurized reactor vessel 20 has an opening, reactor vessel outlet 21, to allow biomass material and steam to exit the pressurized reactor vessel 20 and pass into the discharge line 24. A studding outlet 40 surrounds the opening, reactor vessel outlet 21, and is fixed to the outer surface of the sidewall 36. The studding outlet 40 supports the valve 22 that provides the coupling between the pressurized reactor vessel 20 and the discharge line 24. An optional nozzle insert 42 may fit in the opening created by reactor vessel outlet and provide a smooth, low resistance path for the steam and biomass material from the pressurized reactor vessel 20 to the discharge line 24. The nozzle insert 42 may be in the opening, reactor vessel outlet 21, or in the studding outlet 40. The nozzle insert 42 may be a replaceable insert and used to reduce the size of the opening created by reactor vessel outlet 21 to conform the opening to the diameter of the flow passage in the discharge line 24. The nozzle insert 42 may be either removed or replaced with a nozzle insert 42 having a different sized passage if the discharge line 24 is replaced with a discharge line 24 having a different diameter. Nozzle inserts 42 for this use can be similar to those presented and described in co-pending U.S. application Ser. No. 13/029,801, incorporated herein by reference and a copy of which is attached.

During normal operation and if the corresponding discharge line 24 is selected to be active, the valve 22 may have a fully open position, which does not restrict the flow of biomass material and steam through the valve 22. If the discharge line is selected to be inactive, the valve 22 may have a fully closed position that entirely blocks biomass material and steam from entering the discharge line 24.

An orifice plate 44 may be positioned between the valve 22 and the one or more discharge lines 24. The orifice plate 44 may be annular and have a generally circular opening 46 which allows biomass material and steam to flow into the one or more discharge lines 24. The generally circular opening 46 in the orifice plate 44 may be sized to achieve a desired flow rate restriction to the biomass material and steam flowing into the discharge line 24. Various orifice plates 44 may be available for placement between the valve 22 and the discharge line 24. One of the orifice plates 44 may be selected to achieve a desired flow restriction at the inlet to the discharge line 24. The orifice plate 44, nozzle insert 42, valve 22, discharge lines 24, collection-expansion manifold 26, and collection line 28 may be formed of a material, such as a metal, hard polymer material, or ceramic selected to withstand the chemicals of the biomass material, steam, and other environmental considerations.

Figure 4:
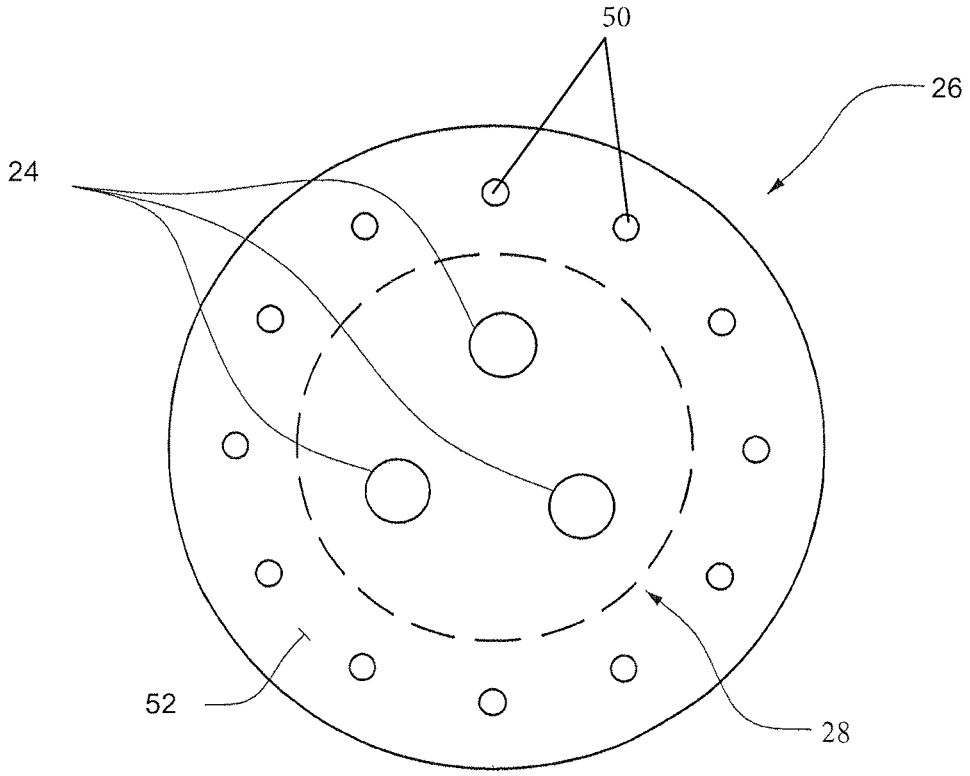
FIG. 4 is a schematic view of an end view of the collection-expansion manifold.
Figure 5:
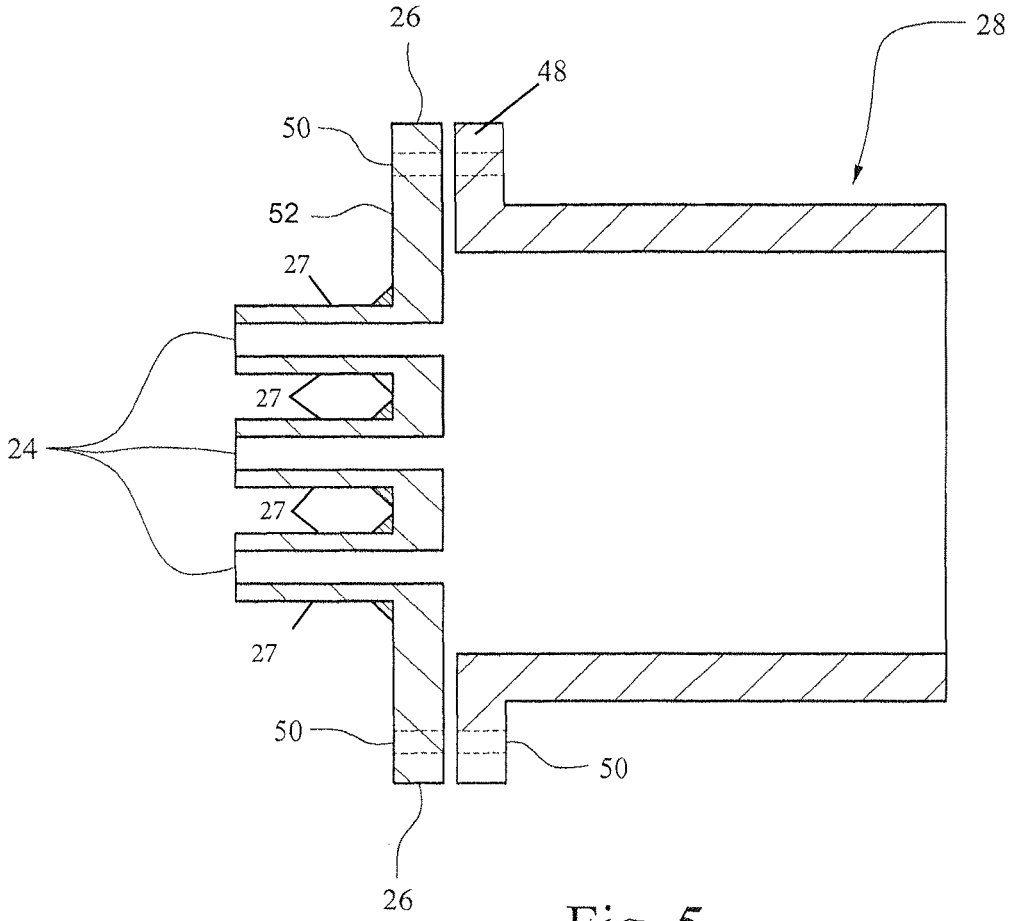
FIG. 5 is a schematic diagram of a side view of the collection-expansion manifold.

FIGS. 4 and 5 are schematic diagrams of an end view (FIG. 4) and a side view (FIG. 5) of the collection-expansion manifold 26. The collection-expansion manifold 26 may be a circular metal plate having an outer annular ring 52 that serves as a coupling flange for a matching flange 48 at the inlet of the collection line 28. Matching circular arrays of bolt holes 50 in the outer annular ring 52 and flange 48 provide passages for connecting bolts that secure the collection-expansion manifold 26 to the collection line 28. In other example embodiments, the collection-expansion manifold 26 may be connected to the collection line 28 by other means, such as welding. The circular dotted line in FIG. 4 represents the perimeter of the passage through the collection line 28.

The discharge line outlet ends 27 may be connected to one side of the collection-expansion manifold 26 and the inlet of the collection line 28 is connected to the other side of the collection-expansion manifold 26. The discharge lines 24 are aligned with bolt holes 50 that extend through the surface of the collection-expansion manifold 26. The discharge line outlet ends 27 of the discharge lines 24 may be fixed to the collection-expansion manifold 26 by being welded to the collection-expansion manifold 26 (as shown in FIG. 5), coupled by a flange on each discharge line 24 that bolts to the collection-expansion manifold 26, or coupled in some other manner. There may be no restriction to the flow of biomass material and steam as they flow through the discharge lines 24, pass through the collection-expansion manifold 26 and into the collection line 28. The side of the collection-expansion manifold 26 that connects to the collection line 28 may include recesses that allow for the inclusion of wear nozzles or inserts at the exit of each discharge line 24. This arrangement would allow replacement of worn collection-expansion manifold 26 part or parts without requiring the replacement of the entire collection-expansion manifold 26.

An option for a separate nozzle or combination of nozzles may be used to inject water or chemicals before, in, near, or after the collection-expansion manifold 26.

The position of the collection-expansion manifold 26 and the length of the collection line 28 may be selected to achieve relatively short discharge lines 24 and thereby reduce the risk of plugging, blocking, or obstruction in the lines due to biomass deposits and/or tramp material, and to accommodate the plant layout and existing equipment. Further, the collection-expansion manifold 26 may be replaceable to allow for changes in number of discharge lines 24. In other example embodiments, the collection-expansion manifold 26 may have connections for extra discharge lines 24 that potentially may be added after the collection-expansion manifold 26 is initially installed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An apparatus for steam explosion treatment of biomass material comprising:

a pressurized reactor vessel configured to contain biomass material and steam;

at least one discharge line coupled to an outlet of the pressurized reactor vessel, wherein the at least one discharge line has a cross-sectional area and wherein the at least one discharge line is configured to receive the biomass material and the steam discharged from the pressurized reactor vessel;

a collection-expansion manifold connected to an outlet end of the at least one discharge line;

a collection line having an inlet connected to the collection-expansion manifold, wherein the collection line is configured to receive the biomass material and the steam flowing from the outlet end of the at least one discharge line, and wherein the collection line has a cross-sectional area that is substantially larger than the cumulative cross-sectional area of the at least one discharge line; and a separation device coupled to an outlet end of the collection line to receive the biomass material and the steam from the collection line, and the separation device includes a gas outlet and a biomass material outlet.

2. The apparatus of claim 1, wherein a length of the at least one discharge line is substantially shorter than a length of the collection line.

3. The apparatus of claim 1, wherein the cross-sectional area of the collection line is at least twice to four-hundred times the cross-sectional area of any one of the at least one discharge lines.

4. The apparatus of claim 1, wherein a pressure in the inlet of the collection line is substantially less than a pressure in the outlet end of the discharge line.

5. The apparatus of claim 1, further comprising a valve for each of the at least one discharge lines, wherein each valve is positioned between the reactor vessel and an inlet of the at least one discharge line.

6. The apparatus of claim 5, wherein each valve has a fully-open and a fully-closed operating position.

7. The apparatus of claim 1, wherein the number of discharge lines is at least two.

8. The apparatus of claim 7, wherein an internal diameter of each of the discharge lines is substantially uniform throughout each of the discharge lines.

9. The apparatus of claim 7, wherein the internal diameter of at least one of the discharge lines has a cross-sectional area that is larger than a cross-sectional area of another one of the discharge lines.

10. The apparatus of claim 1, wherein the internal diameter of at least one of the plurality of discharge lines has a cross-sectional area that is smaller than a cross-sectional area of at least one other discharge line in the plurality of discharge lines.

11. The apparatus of claim 1 further comprising a plurality of collection lines, wherein each collection line is configured to receive the biomass material and the steam from at least one discharge line.

12. A method for steam explosion treatment comprising:

pressurizing and infusing biomass material with steam in a pressurized reactor vessel to create a pressurized and infused biomass material;

passing the pressurized and infused biomass material and the steam from the pressurized reactor vessel through at least one of a plurality of reactor vessel outlets into at least one of a plurality of discharge lines;

passing the pressurized and infused biomass material from the at least one of the discharge lines through an expansion manifold and into a collection line;

rapidly reducing pressure on the pressurized and infused biomass material as the pressurized and infused biomass material enters the collection line from the collection-expansion manifold to create steam exploded biomass material;

transporting the steam exploded biomass material through the collection line to a separation device, in which the steam exploded biomass material is separated from gases flowing with the steam exploded biomass material in the collection line.

13. The method of claim 12, wherein a distance travelled by the pressurized and infused biomass material through the plurality of discharge lines is substantially shorter than a length of the collection line.

14. The method of claim 12, wherein at least one of the discharge lines is closed to the pressurized and infused biomass material by a valve positioned between the pressurized reactor vessel and an inlet of the at least one of the discharge lines while at least one other one of the discharge lines is open to and is receiving biomass material.

15. The method of claim 12 further comprising selectively opening at least one of the plurality of discharge lines to achieve a certain combined flow rate of the biomass material and the steam through the expansion manifold.

16. The method of claim 12, wherein at least one of the discharge lines or a nozzle inserted proximate to an inlet of the at least one of the plurality of discharge line defines a flow passage having a cross-sectional area that is substantially less than the cross-sectional area of at least one other discharge line of the plurality of discharge.

17. An apparatus for steam explosion treatment of biomass material comprising:

At least one discharge line extending from the pressurized reactor vessel at reactor vessel outlets, wherein the at least one discharge line has a cross-sectional area and wherein the at least one discharge line is configured to receive the biomass material and the steam discharged from the pressurized reactor vessel;

a collection-expansion manifold connected to an outlet end of the at least one discharge line;

a collection line having an inlet connected to the collection-expansion manifold, wherein the collection line is configured to receive the biomass material and the steam flowing from the at least one discharge line, and wherein the collection line has a cross-sectional area that is substantially larger than the cross-sectional area of the at least one discharge line; and a separation device coupled to an outlet end of the collection line, wherein the separation device is configured to receive the biomass material and the steam from the collection line.

* * * * *